United States Patent [19]

Nomura et al.

[11] 4,188,812

[45] Feb. 19, 1980

[54] INSTALLATION FOR PRODUCTION OF CONTINUOUSLY COLD ROLLED SHEET METAL OR STRIP

[75] Inventors: Susumu Nomura; Hiromasa Hirata, both of Yokohama; Hisashi Takahashi; Takao Kawanami, both of Tokai; Takashi Furuya, Tokyo, all of Japan

[73] Assignees: Ishikawajima-Harima Jukogyo Kabushiki Kaisha; Nippon Steel Corporation, both ofTokyo, Japan

[21] Appl. No.: 685

[22] Filed: Jan. 3, 1979

[51] Int. Cl.[2] ..... B21B 1/28; B21B 45/04

[52] U.S. Cl. ..... 72/227; 72/250; 134/122 R; 72/203

[58] Field of Search ..... 72/149, 250, 226, 227, 72/161, 234; 134/64 R, 122 R

[56] References Cited

U.S. PATENT DOCUMENTS 3,543,775 12/1970 Bodnar ..... 134/64 R

FOREIGN PATENT DOCUMENTS 50-91463 12/1975 Japan .
51-156553 7/1976 Japan .

*Primary Examiner*—Milton S. Mehr
*Attorney, Agent, or Firm*—Scrivener Parker Scrivener &Clarke

[57] ABSTRACT

An installation for the production of continuously cold rolled sheets or strips wherein the continuous operation is effected when a coil of the cold rolled sheet metal or strip is directly and effectively produced from a coil of the hot rolled sheet metal or strip.

4 Claims, 10 Drawing Figures

INSTALLATION FOR PRODUCTION OF CONTINUOUSLY COLD ROLLED SHEET METAL OR STRIP

DETAILED DESCRIPTION OF THE INVENTION

The present invention relates to a continuous cold rolling mill.

In a cold rolling mill, prior to cold rolling a coil of hot-rolled strip is uncoiled and chemically descaled or pickled so as to remove scale. FIG. 1 shows a typical high-speed pickling line consisting of an uncoiling and welding station A, a pickling station C and a re-coiling station E.

A sheet metal or strip S is uncoiled from an uncoiling device such as a payoff reel 1, and made flat by a flattener 2. In order to joint the preceding strip and the succeeding strip, an upcut shear 3 shears off the off-gage portions at the trailing end of the preceding strip and at the leading end of the succeeding strip, and the preceding and succeeding strips S are joined by a flash-butt welder 4. The strip S emerging from the welder 4 passes a deflector roll 5 and forms a free loop 6 so that the variations in tension exerted to strip S in the uncoiling and welding station A will not adversely affect the pickling process. If the tension of the strip S can be suitably controlled with electrical means, the free loop 6 may be eliminated.

The strip S emerging from the free loop 6 enters an accumulator. Bridle rolls 7 are located at the entrance to the accumulator B in order to exert desired tension to the strip S. Loop cars 8 are displaced so that the amount of strip S extending through the accumulator B may be suitably controlled. Disposed at the entrance side of the accumulator B are automatic strip position control rolls 9 so that the trucking of the strip S in the pickling station C may be optimumly controlled.

The strip S emerging from the accumulator passes through a long pickling tank 11 in the pickling station C so as to remove scale. The strip S emerging from the pickling tank 11 passes through a neutralizing station 12, a water washing station 13 and a drying station 14 and is led through bridle rolls 15 into an exit accumulator D. The tension exerted to the strip S subjected to the pickling process is controlled by bridle rolls 10 at the entrance side of the pickling tank 11.

As with the entrance accumulator B, the exit accumulator D is provided with automatic strip position control rolls 16, loop cars 17 and bridle rolls 18.

The strip S emerging from the bridle rolls 18 forms a free loop 19 and then enters a side trimmer 20 which trims the sides of the strip S in order to provide the strip S with a uniform width.

The strip S emerging from the side trimmer 20 enters bridle rolls 21 which impart high tension to the strip S to be re-coiled. Thereafter the strip S is sheared by an upcut shear 22, applied with an anti-corrosion oil with a deflector roll 23 and coiled again around a coil winding device 24.

The pickling line of the type described is approximately 330 m in length, and the pickling processing speed is approximately 300 m/min.

Next the mode of operation will be described in more detail hereinafter. The strip S is uncoiled from the payoff reel 1, flattened by the flattener 2 and sheared by the upcut shear 3 in such a way that the off-gage portions at both the leading and trailing edges may be out off and the leading and trailing ends may be perpendicular to the axis of the strip S. The trailing end of the strip S is welded to the leading end of the preceding strip by the welder 4. The continuous strip S passes the entrance accumulator B and enters the pickling station C. As it passes through the pickling tank 11, scale is completely removed. Thereafter, it is subjected to the neutralization process at 12 so that the acid still adhering to the surfaces of the strip S may be neutralized. After passing through the washing and drying stations 13 and 14 and the exit accumulator D, the sides of the strip S are cut by the side trimmer 20. Thereafter the continuous strip S is sheared by the shear 22, applied with the anti-corrosion oil by the deflector roll 23 and re-coiled by the coil winding device 24.

In the pickling line of the type described, the strip S must pass through the pickling station C continuously even though it must be held stationary in the uncoiling and re-coiling stations A and B for shearing, welding and trimming as described above. This is the reason why the accumulators B and D are provided at the entrance and exit of the pickling station C. It is these long accumulators B and D that permit the strip S to pass through the pickling station C at a predetermined constant speed.

FIG. 2 shows the relationship between the time and the velocity of the strip S passing through the pickling station C. The lengths of the strip S accommodated in the entrance and exit accumulators B and D are dependent upon the diameters (that is, the lengths) of the strip coils. As a result, it is not possible to always have the strip S pass through the pickling station at its maximum velocity. That is, the strip S is passed through it at a constant velocity lower than the maximum velocity. Thus, the average processing capacity of the pickling line may be represented the mean velocity shown in FIG. 2.

For instance, if the maximum processing speed of the pickling station C is 300 m/min, the uncoiling station A must feed the strip S at a rate of about 750–800 m/min so that the entrance accumulator B may store a sufficient length of strip S so as to permit the strip S to pass through the pickling station C at the maximum speed of 300 m/min. The difference between them is due to the fact that in order to shear the strip S and weld the preceding and succeeding strips together as described above, the strip S must be stopped at least a few minutes in the uncoiling station A. As a result, the entrance accumulator B must be very long.

The strip S emerges out of the pickling station C and enters the re-coiling station E at the rate of 500 m/min under the above conditions.

Of all the devices of the pickling line, the side trimmer 20 in the re-coiling station E most affects the operation efficiency. That is, in order to reduce the consumption of the pickling solution to the minimum, an ideal position of the side trimmer 20 is at the upstream of the pickling station C. However, as described above, the uncoiling station A feeds the strip at the rate of 800 m/min which is too fast for the side trimmers available at present to follow. That is, at the present state of the art, it is impossible to install the side trimmer 20 at the upstream of the pickling station C.

An alternative position of the side trimmer 20 is within the pickling station C itself, but since the strip S must be continuously fed throughout the whole length of the pickling tank 11 in order to prevent the strip over pickling, it is impossible to change the width of the strip S and to replace the cutting blades. Thus, it is also impossible to locate the side trimmer 20 in the pickling station C.

Therefore, the side trimmer 20 is installed in the re-coiling station E in the existing pickling line. The strip S is permitted to stop at the side trimmer 20 only for 30 seconds because the strip S is continuously fed out from the pickling station C. As a result, the change in width cut by the side trimmer 20 and the replacement of cutting blades thereof must be made within a very short time interval. Furthermore, as described above, the strip S is passing at such high a rate of 500 m/min in the re-coiling station E, the change and replacement become further difficult, resulting in the temporary shutdown of the pickling line. In order to overcome this problem, the existing pickling lines are in general provided with two side trimmers in tandem.

In addition to the problem of the side trimmer, the prior art pickling line has another serious problem which arises from the fact that acids are used for removing scale from the strip. That is, the very huge system for recovering the used acids and treating them must be installed, thus resulting in the increase in length and space of the pickling line and installation cost thereof. Furthermore, the use of acids leads to the pollution problems so that the anti-pollution system must be installed additionally. Thus, the overall cost of removing scale from strip becomes very high.

FIG. 3 shows a cold rolling mill 25 consisting of a plurality of rolling mill stands arranged in tandem. The hot rolled and pickled strip S is uncoiled from the coil winding device 24 and re-coiled around a payoff reel 1. Thereafter the strip is cold rolled to a desired gage by the continuous cold rolling mill 25 and recoiled again around the coil winding device 24.

The pickling line shown in FIG. 1 and the continuous cold rolling mill shown in FIG. 3 are in general installed independently of each other so that the coils of strip must be transported by overhead-cranes or specially-designed trucks from the pickling line to the continuous cold rolling mill. In general, the coils of pickled strip are not immediately delivered to the continuous cold rolling mill. That is, the coils of pickled strip are temporarily stored for suitable time intervals and then transported to the continuous cold rolling mill. As a result, a large storage space is required for the storage of coils of pickled strip between the pickling line and the continuous cold rolling mill. Furthermore, residual acids cause rusting of strip during the storage.

FIG. 4 shows another example of a prior art continuous cold rolling mill especially designed for increasing the production efficiency. That is, the upcut shear 3, the flash-butt welder 4 and an accumulator B' are interposed between the uncoiling device 1 and the continuous cold rolling mill 25, and the upcut shear 22 is installed at the downstream of the continuous cold rolling mill 25.

In view of the rapid increase in labor cost, the demand for high productivity, the higher yield and savings in materials and energy, much efforts have been made in order to shorten a continuous cold rolling mill and to attain the continuous processing from ingots to cold rolled strips. One effort is directed to a continuous pickling and tandem cold rolling mill line, but because of various technical problems none exists at present. The problems which hinder the realization of the continuous pickling and cold rolling mill line are as follows:

(1) As shown in FIG. 1, the hot-rolled strip must pass through the long pickling tank. Since the pickling rate (that is, the rate of removal of scale in a pickling solution) is constant, the strip must be continuously passed through the tank at a constant rate. Meanwhile, the entering velocity of a material entering a pair of work rolls varies depending upon the reduction ratio so that the leaving velocity varies accordingly. Therefore, there must be provided means which enables the strip emerging out of the pickling station at a constant velocity to enter the first pair of work rolls of the tandem continuous cold rolling mill at a suitable velocity which varies as described above.

(2) Unless the hot-rolled strip passes through the pickling line at a constant velocity, over-descaling results, leading to a poor yield. Furthermore, the strip is discoloured by acid, resulting in the degradation of the quality of the pickled strip. In addition, the consumption of the pickling solution increases, leading to the increase in the production cost. Moreover, in the continuous cold rolling mill, the work rolls must be replaced periodically according to the schedules so that the continuous cold rolling mill must be shut down.

(3) The pickling solution inevitably adheres to the surfaces of the strip emerging from the pickling tank, causing rusting of the strip. Furthermore, vapor evolving from the pickling solution causes the corrosion of the peripheral machines and equipment, especially the motors for driving the rolling mill stands.

(4) Tables I and II below show the relationship between the desired quantities of strips with designated specifications and the capacities required of the production lines, the specifications of which are described below:

Pickling Line:
Type: 5 tanks each containing a solution of hydrochloric acid
Gage: 1.2–6.0 mm
Width: 500–1,650 mm
Velocities: entering velocity: 600 m/min leaving velocity: 220 m/min
Weight of Coil: 40 ton (maximum)
Continuous Cold Rolling Mill:
Type: 5 rolling-mill stands arranged in tandem
gage: 0.3–3.2 mm
width: 700–1,600 mm
Velocity: 1,500 m/min (maximum)
Weight of Coil: 40 ton (maximum)

Table I

| Capacity against products in each line | | | | | |
|---|---|---|---|---|---|
| Products | | | Capacity (ton/hr) | | |
| gage (mm) | width (mm) | production volume (1,000 tons/month | pickling line | Continuous cold rolling line | Continuous pickling and cold rolling mill line |
| 2.0 → 0.23 | 800 | 6 | 225.9 | 134.9 | 134.9 |
| | 960 | 1 | 276.0 | 162.5 | 162.5 |
| 2.3 → 0.27 | 800 | 39 | 255.0 | 157.5 | 157.5 |
| | 960 | 85 | 311.6 | 189.9 | 189.9 |
| 2.3 → 0.35 | 800 | 84 | 255.0 | 202.3 | 202.3 |
| | 960 | 157 | 311.6 | 244.1 | 244.1 |
| | 1,200 | 70 | 386.5 | 265.8 | 265.8 |
| 2.5 → 0.45 | 800 | 42 | 272.8 | 256.9 | 256.9 |
| | 960 | 439 | 324.8 | 310.5 | 310.5 |
| | 1,200 | 161 | 415.4 | 315.8 | 315.8 |
| | 1,450 | 45 | 483.5 | 316.7 | 316.7 |
| 2.5 → 0.55 | 960 | 235 | 324.8 | 375.2 | 324.8 |
| | 1,200 | 488 | 415.4 | 385.8 | 385.8 |
| | 1,450 | 78 | 483.5 | 387.2 | 387.2 |

Table I-continued

| Capacity against products in each line | | | | | |
|---|---|---|---|---|---|
| Products | | | Capacity (ton/hr) | | |
| gage (mm) | width (mm) | production volume (1,000 tons/month | pickling line | Continuous cold rolling line | Continuous pickling and cold rolling mill line |
| | 1,700 | 171 | 517.7 | 389.4 | 389.4 |
| 2.8 → 0.7 | 960 | 272 | 368.2 | 425.8 | 368.2 |
| | 1,200 | 563 | 450.3 | 430.2 | 430.2 |
| | 1,450 | 416 | 507.9 | 431.8 | 431.8 |
| | 1,700 | 192 | 541.5 | 434.7 | 434.7 |
| 3.2 → 1.0 | 960 | 1,484 | 407.6 | 495.8 | 407.6 |
| | 1,200 | 1,568 | 495.0 | 501.7 | 495.0 |
| | 1,450 | 876 | 554.7 | 504.1 | 504.1 |
| | 1,700 | 972 | 586.5 | 508.0 | 508.0 |
| 3.8 → 1.6 | 960 | 314 | 421.2 | 718.3 | 421.2 |
| | 1,200 | 556 | 511.0 | 780.3 | 511.0 |
| | 1,450 | 135 | 571.3 | 786.2 | 571.3 |
| | 1,700 | 218 | 602.3 | 795.8 | 602.3 |
| 5.2 → 2.6 | 960 | 96 | 464.5 | 955.9 | 464.5 |
| | 1,200 | 110 | 561.9 | 1,038.2 | 561.9 |
| | 1,450 | 33 | 623.6 | 1,047.9 | 623.6 |
| | 1,700 | 94 | 651.4 | 1,036.6 | 651.4 |

Table II

| | Capacity of each line | | |
|---|---|---|---|
| | pickling line | Continuous cold rolling line | Continuous pickling and cold rolling line |
| operation efficiency (%) | 95 | 89.2 | 84.7 |
| production capacity(ton/hr) | 454.1 | 456.4 | 418.6 |
| periodic maintenance (hr/month) | 40 | 48 | 48 |
| processing capacity (ton/month) | 294.2 | 274.4 | 239.0 |

From the above specifications and Tables I and II, it is apparent that, a mere combination of a pickling line with a continuous cold rolling mill will not attain an optimum result.

One of the objects of the present invention is therefore to provide a continuous cold rolling mill which may substantially overcome the above and other problems encountered in the prior art continuous cold rolling mills.

The present invention will become apparent from the following description of some preferred embodiments thereof taken in conjunction with the accompanying drawings, in which.

First Embodiment, FIGS. 5–8

Figure 1:
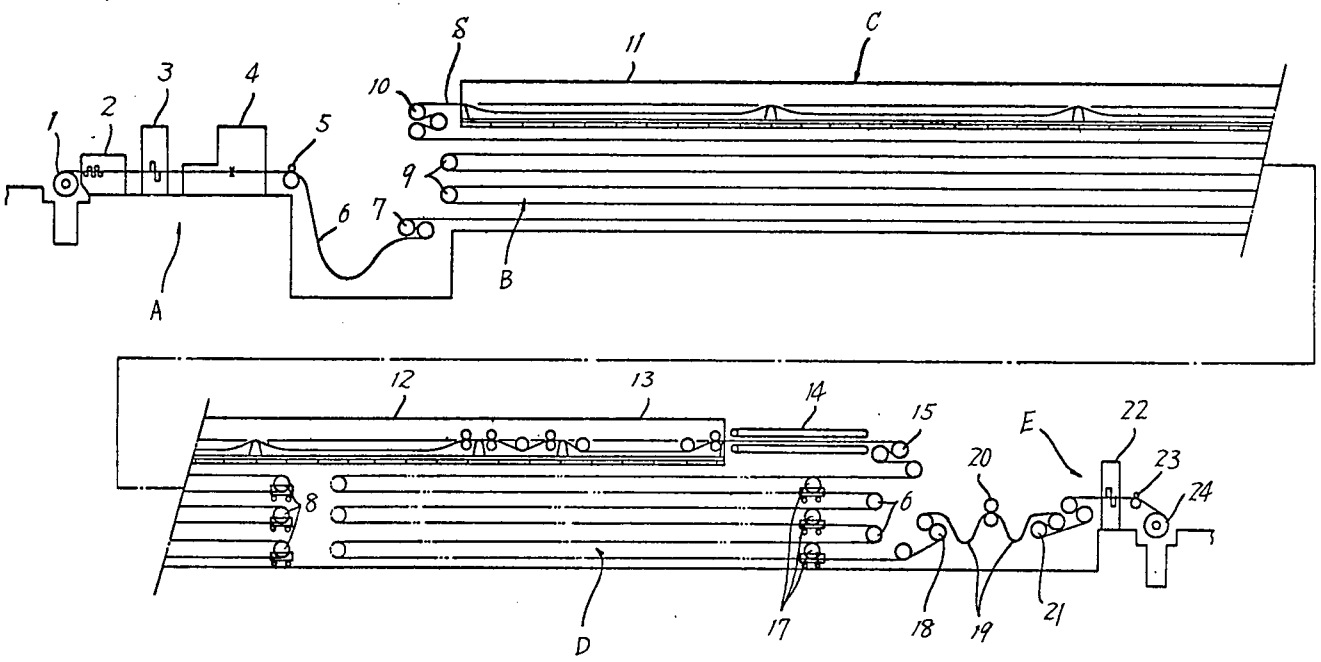
Fig. 1 PRIOR ART
FIG. 1 is a diagrammatic view of a high-speed pickling line in a prior art continuous cold rolling mill.
Figure 2:
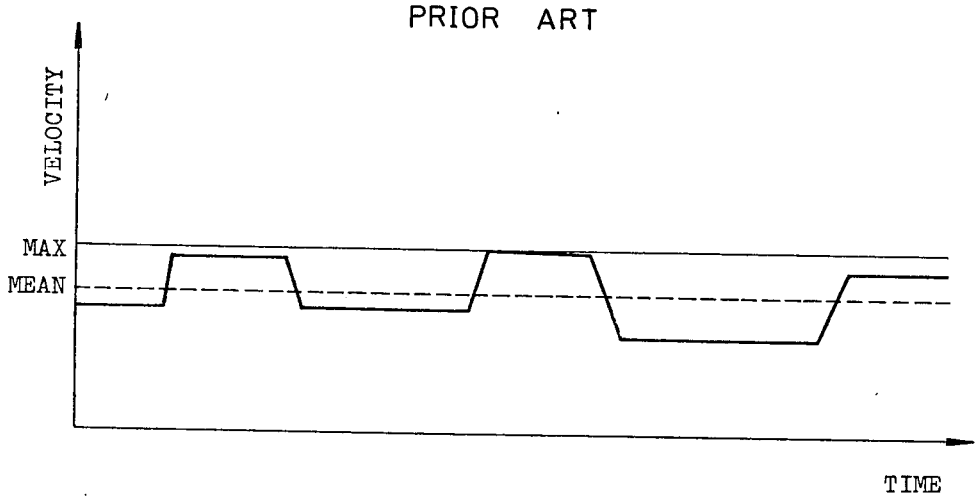
Fig. 2 PRIOR ART
FIG. 2 shows the relationship between the velocity of a strip passing through the pickling line shown in FIG. 1 and time.
Figure 5:
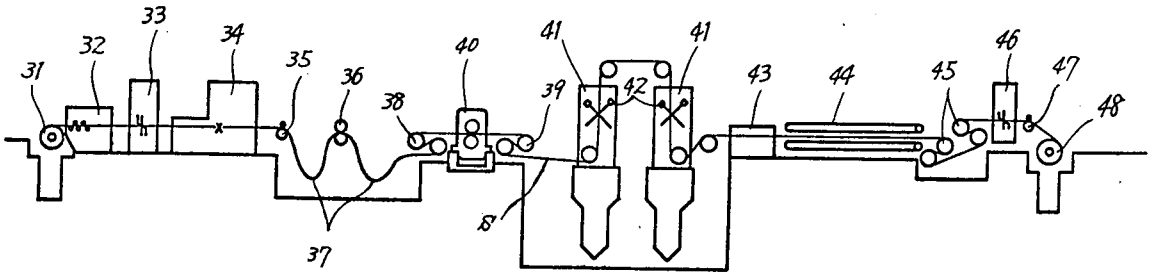
FIG. 5 is a diagrammatic view of a mechanical descaling line in accordance with the present invention.

Referring to FIG. 5, the uncoiling station includes a payoff reel or uncoiler 31, a flatener 32, an upcut shear 33, a flash-butt welder 34 and a deflector roll 35, all of which are substantially similar in construction and operation to those described elsewhere with reference to FIG. 1.

The strip emerging from the deflector roll 35 enters a side trimmer 36. The strip entering and leaving the side trimmer 36 forms free loops 37 so as to ensure the smooth operation of the trimmer 36.

The side trimmer 36 consists of a scrap blower, or a chopper. As described elsewhere, the side trimmer is disposed in the line ksucceeding the pickling line in the prior art continuous cold rolling facilities, but in accord with the present invention, it is disposed at the upstream of the mechanical de-scaler in order to attain economy of energy.

Bridle rolls 38 and 39 are disposed at the downstream of the side trimmer 36 and are spaced apart from each other by a suitable distance. Interposed between these bridle rolls 38 and 39 is a scale breaker 40 which has a dual function of correcting the shape of the strip S and reducing it under high pressures (at a percentage reduction ratio of higher than 6%) so that scale on the strip S may be easily, uniformly and efficiently removed. The scale breaker 40 consists of a skin pass mill, a leveler and so on. The percentage reduction ratio attainable by the prior art skin pass mills is of the order of 1% at the most, but in accordance with the present invention it is higher than 6%, which is one of the novel features of the present invention.

A plurality of mechanical descaling equipment or descalers 41 are arranged in tandem at the downstream of the scale breaker 40. Each descaler 41 is adapted to mechanically scrape off scale from the surfaces of the strip S so that the latter may be subjected to the cold rolling process. The descaler 41 may be of the shot blasting type such as liquid honing or of the polishing type such as buff rolls, but in the first embodiment the liquid honing machines are used. That is, the descaler 41 has nozzles 42 for projecting polishing slurry such as iron sand and water under high pressure (25–200 $kg/cm^2$ G) against the surfaces of the strip S. The slurry and water are sprayed through different nozzles holes of the nozzles 42. Thus scale on the surfaces of the strip S passing at high speed through the descaler 41 can be effectively removed by the impinged polishing slurry and water under high pressure.

The mechanical descaler 41 incorporates a slurry recirculation system as well as a water recirculation system. The nozzles 42 are spaced apart from each other by a suitable distance transversely of the strip S so that the latter may be subjected to the uniform descaling operations.

Disposed at the downstream of the mechanical descaling station (consisting of a plurality of mechanical descalers 41 of the type described) is an after-treatment station 43 which impinges fresh water under high pressure against the surfaces of the strip S, thereby removing the polishing slurry or abrasives remaining on the surfaces of the strip S. The strip S emerging from the after-treatment station 43 enters a drying station 44, passes bridle rolls 45, is sheared off by an upcut shear 46, applied with an anti-rusting oil by a deflector roll 47 and finally recoiled around a recoiler 48 which is adapted to exert suitable tension to the strip S and to wind it with the sides of respective turns being aligned correctly.

The over-all length of the processing line shown in FIG. 5 is approximately 150 meters.

Next the mode of operation of the first embodiment will be described in more detail hereinafter. First the strip S uncoiled from the uncoiler 31 is made flat by the flatener 32 and enters the upcut shear 33 where the off-gage portions at both the leading and trailing ends of the strip S are cropped off in such a way that the leading and trailing ends are perpendicular to the axis of the uncoiled strip S. Thereafter the strip S is advanced into the flash-butt welder 34 where the leading edge of the strip S is welded to the trailing edge of the preceding strip S, whereby a plurality of lengths of strip may be joined into a continuous strip.

The strip S emerging from the welder 34 is deflected by the deflector roll 35 so as to form the free loop 37 in the form of a concave directed upward before entering the side trimmer 36. The latter cuts off the sides of the strip S so that the latter may have a predetermined width. The strip S emerging from the side trimmer 36 forms again the concave upward free loop 37 before entering the scale beaker 40 through the bridle rolls 38. In the scale breaker 40 the strip S is subjected to bending or reduction under high pressure, whereby scale is broken. As a result, the mechanical descalers 41 may easily remove the broken scales. The effects of breaking scale on the strip S by the bending or reduction or both in the scale breaker 40 on the easy and efficient removal of scale by the mechanical methods had been experimentally confirmed as will be described hereinafter. Furthermore, the scale breaking process is needed in order to avoid the adverse effects on the mechanical descaling operations of the strip S whose surfaces deform like waves when passing through a plurality of deflector rolls in the descalers 41.

The strip S, whose shape is corrected and whose scale is broken in the scale breaker 40, passes over the bridle rolls 39 and enters the first mechanical descaler 41. The polishing slurry and water under high pressure are impinged against the surfaces of the strip S as described elsewhere, whereby scale on the strip S may be completely removed. The strip S thus descaled enters the after-treatment or washing station 43 so that the abrasives remaining on the surfaces of the strip S may be completely washed away. The strip S emerging from the after-treatment station 43 enters the drying station 44 where the strip S is dried. The strip emerging from the drying station 44 passes the bridle rolls 45 and enters the upcut shear 46 where the strip S is sheared off to an original length. Thereafter the strip S is applied with the anti-rusting oil by the deflector roll 47 and is recoiled by the recoiler 48.

Figure 6:
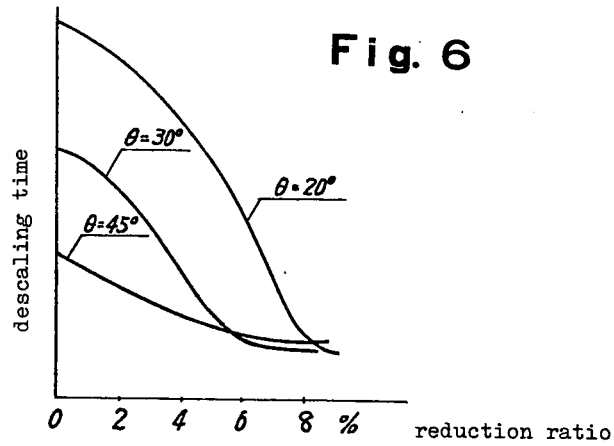
FIG. 6 is a graph showing the relationship between the reduction ratio and the polishing slurry ejection time of a mechanical scale breaker incorporated in the production line shown in FIG. 5.
Figure 7:
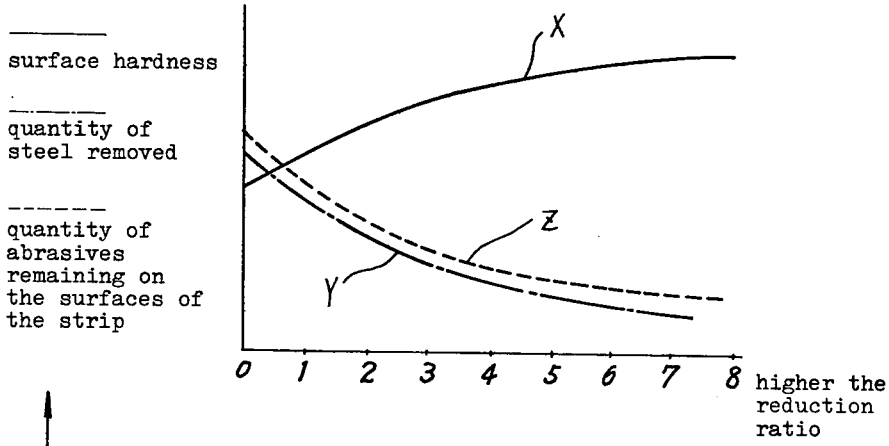
FIG. 7 is a graph showing the relationship between the elongation on the one hand and the surface hardness, the quantity of steel removed by polishing or grinding, and the quantity of abrasives adhered to and remained on the surfaces of the strip.

Next the reason why the strip S is subjected to the reduction under high pressure in the scale breaker 40 will be described in detail hereinafter. Referring to FIG. 6, when the reduction ratio is of the order of between 6 and 8%, the descaling time interval becomes shorter regardless of the angle (20°, 30° and 45°) of the nozzles 42 with respect to the surfaces of the strip S. For instance, with the nozzle angle of 45°, the descaling time interval becomes almost one half as compared with the case where the strip is not subjected to the reduction at all. This means that the descaling efficiency is doubled. Furthermore, as indicated by the curve X in FIG. 7, the higher the reduction ratio, the harder the strip becomes and the lesser the quantity of the material removed by the mechanical descaling becomes as indicated by the characteristic curve Y so that the yield is increased. Moreover, the higher the reduction ratio, the smaller the quantity of abrasives remaining on the surfaces of the strip as indicated by the curve Z. The reason is that as the surface hardness of the strip is increased, the possibility of abrasives adhering or sticking the surfaces of the strip becomes less.

According to the present invention, no pickling line is used in order to remove scale from the strip. As a result, even when the strip S is stopped in the mechanical descalers 41 by some cause, there will arise no adverse effect upon the over-all operation of the production line. For instance, when the strip S is stopped in the mechanical descaler 41, the spraying pressures of water and abrasive are lowered so as to avoid the over-descaling. Thus, regardless of the diameters of the coils of hot-rolled strip, the production or descaling line shown in FIG. 5 can process the strip S at a maximum speed at any time. Furthermore, in case of mounting a new coil on the uncoiler 31 or unloading the coil of processed strip from the recoiler 48, the processing line may be shut down.

Figure 8:
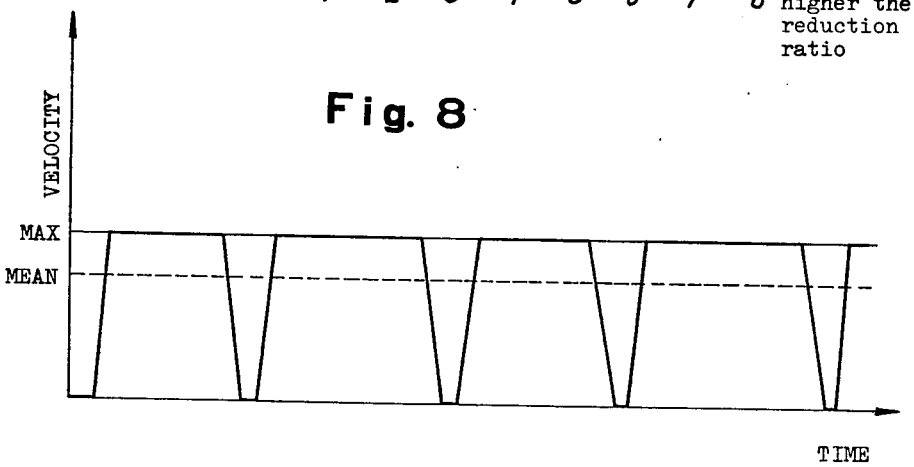
FIG. 8 is a graph showing the relationship between the velocity of a strip passing through a high-speed pickling line incorporated in the production line shown in FIG. 5 and time.

The processing line described so far with reference to FIG. 5 has a further advantage in that it may maintain an average processing speed comparable to that of the facility shown in FIG. 1, as indicated in FIG. 8. As a result, opposed to the prior art processing lines, it is not needed to install enormously long accumulators at the upstream and downstream of the mechanical descaling station. This is one of the most important features which can be obtained only by the employment of the mechanical descalers 41 of the type described above. Because of the mechanical descalers 41, the energy required for accomplishing the desired surface treatment of the strip; that is, the energy required for impinging abrasives as well as water under high pressure against the surfaces of the strip to be treated may be easily controlled. Furthermore, when the processing line is shut down, the energy supply may be also interrupted. More particularly, in case of the wet type blasting as with the first embodiment, the impinging pressures of abrasives and water may be suitably controlled by means of control valves or motors.

Opposed to the prior art processing lines, the side trimmer 36 is disposed at the upstream of the mechanical descaling station consisting of descalers 41 so that the strip S can be cut to a predetermined width prior to entering the mechanical descaling station. As a result, the descaling of unwanted portions of the strip may be avoided so that the descaling energy may be saved. It is the elimination of the accumulators of the type described above elsewhere with reference to FIG. 1 that makes it possible to locate the side trimmer 36 at the upstream of the mechanical descaling station. Furthermore the speed of the strip passing through the processing line may be always maintained at a predetermined speed at any points. For instance, the strip passes through the processing line at a predetermined speed of 300 m/min at any points thereof, whereas the speed of the strip passing through the prior art processing lines varies from one station to another depending upon the nature of processing the strip undergoes. Furthermore, the processing speed may be reduced as compared with the prior art processing lines so that the malfunction or breakdown of the side trimmer 20 may be avoided completely or to a minimum. In addition, the replacement of the cutting blades of the side trimmer 21 may be accomplished while shutting down of the processing line and causing any adverse effects on the operations thereof.

Figure 9:
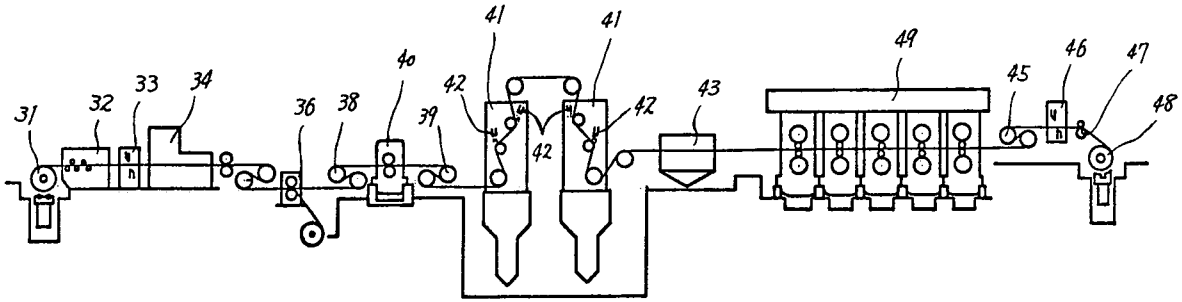
FIG. 9 is a diagrammatic view of a second embodiment of a continuous cold rolling mill in accordance with the present invention.

Second Embodiment, FIG. 9.

The second embodiment shown in FIG. 9 is substantially similar in construction to the first embodiment shown in FIG. 5 except (1) that a continuous cold rolling mill 49 consisting of a plurality of cold rolling mill stands arranged in tandem is interposed between the after-treatment or washing station 43 and the bridle roll 45 leading the strip S to the upcut shear 46 and (2) that no free loop is formed between the welder 34 and the side trimmer 36 and between the side trimmer 36 and the bridle rolls 38 leading the strip into the scale breaker 40 because the tension exerts to the strip passing these sections may be controlled by electric control means.

The mode of operation of the second embodiment shown in FIG. 9 is substantially similar to that of the first embodiment except that the strip emerging from the after-treatment or washing station 43 is subjected to the cold rolling by the continuous cold rolling mill 49. The cold rolled strip emerging from the mill 49 is cut off to a suitable length by the upcut shear 46 by the deflection roll 47 and recoiled by the recoiler.

The cold-rolled sheet or strip production line shown in FIG. 9 is completely continuous. That is, the hot-rolled strip uncoiled from the uncoiler 31 becomes a coil of cold rolled strip. As a result, the devices which must be installed at the upstream of the continuous cold rolling mill 49 in the prior art production lines in order to recoil the strip which has been descaled and to uncoil the descaled strip so as to feed it into the continuous cold rolling mill 49, may be eliminated. Furthermore, the accumulators may be eliminated.

In both the first and second embodiments shown in FIGS. 5 and 9, the mechanical descalers 41 are used which can efficiently and satisfactorily remove sale from the strip in the manner described in detail elsewhere. As a consequence, a chemical descaling device such as a pickling line described with reference to FIG. 1 may be eliminated together with its associated devices required for recovery of used acids and disposal of waste acids.

According to the second embodiment shown in FIG. 9, the storage space for storing the coils between the exit of the descaling line and the entrance to the continuous cold rolling mill may be eliminated. In addition, the transportation means between the descaling line and the continuous cold rolling mill can be eliminated. Thus, the cold rolled sheet or strip production line including the uncoiling station, the welding station, the side cutting station or the side trimmer, the scale breaker, the mechanical descaling station, the washing station, the continuous cold rolling mill and the recoiling station may be made very compact in size.

The production line is further advantageous in that not only the materials but also the energy may be saved considerably. That is, the drying station at the downstream of the pickling tank may be eliminated. Once descaled, the strip is immediately subjected to the cold rolling after having been applied with a lubricating oil. As a result, the oiling device for applying an anti-rusing oil to the strip emerging from the pickling line may be eliminated.

As with the first embodiment shown in FIG. 5, in the second embodiment shown in FIG. 9 the side trimmer 36 is disposed at the upstream of the mechanical descaling station 41 so that the strip entering the latter has a smaller width than the strip as-hot-rolled so that savings in energy required for descaling may be attained. Furthermore the scale breaker 40 reduces the strip under high pressure so as to correct its shape and to uniformly redistribute scales on the surfaces of the strip so that their removal may be much facilitated in the mechanical descaling station 41. As a result, the strip may pass through the production line at a higher speed.

Figure 10:
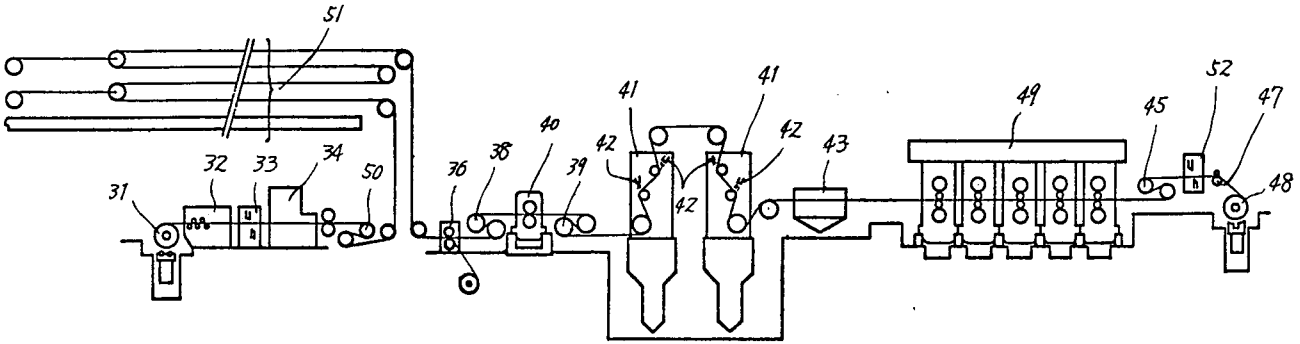
FIG. 10 is a diagrammatic view of a third embodiment of a continuous cold rolling mill in accordance with the present invention.

Third Embodiment, FIG. 10

The third embodiment shown in FIG. 10 is substantially similar in construction to the second embodiment shown in FIG. 9 except (1) that an accumulator 51 is installed between the flash-butt welder 34 (more particularly, bridle rolls 50) and the side trimmer 36 and (2) that instead of the upcut shear used in the first and second embodiments, a flying shear 52 is used which may shear off the strip while travelling. Therefore, even when the production line at the upstream of the mechanical descaling station 41 is shut down by any cause, the continuous cold rolling mill 49 may be operated without any interruption so that the production capacity may be remarkably increased (up to 20 to 30%). Furthermore, the variations in tension exerted to the strip as well as descaling and cold rolling conditions may be avoided so that the strip may be cold rolled to a higher degree of dimensional accuracy. Consequently, no off-gage results, and the yield is increased.

Table III shows, for the sake of comparison, the lists of the process and production equipment required in the prior art production lines and the production lines in accord with the present invention.

TABLE III

Figure 3:
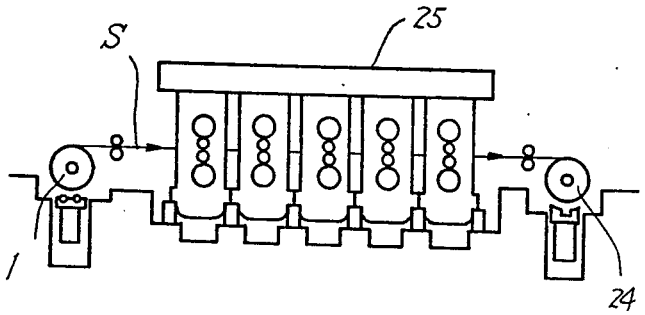
Fig. 3 PRIOR ART
FIG. 3 is a diagrammatic view of a prior art continuous cold rolling mill.
Figure 4:
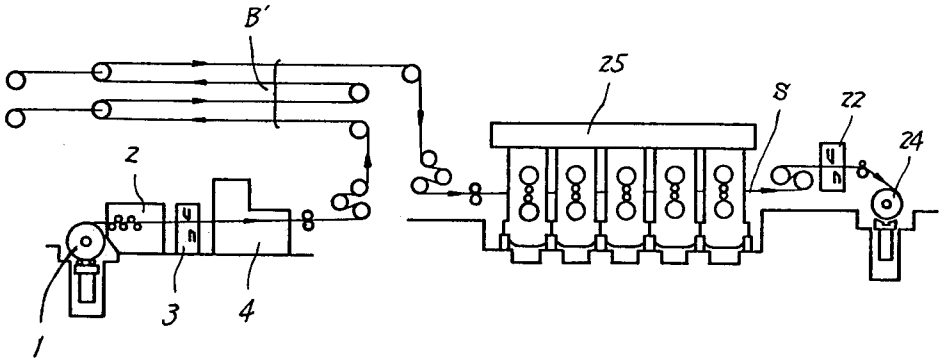
Fig. 4 PRIOR ART
FIG. 4 is a diagrammatic view of another prior art continuous cold rolling mill.

| Comparative Equipment | Prior Art | | The Invention | |
|---|---|---|---|---|
| Kind of equipment | FIG. 1 + FIG. 3 (set) | FIG. 1 + FIG. 4 (set) | FIG. 9 (set) | FIG. 10 (set) |
| Uncoiler | 2 | 2 | 1 | 1 |
| Upcut shear | 2 | 4 | 2 | 2 |
| Flash-butt welder | 1 | 2 | 1 | 1 |
| Accumulator | 2 | 3 | — | 1 |
| Pickling device | 1 | 1 | — | — |
| Heater | 1 | 1 | — | — |
| Washer | 1 | 1 | 1 | 1 |
| Dryer | 1 | 1 | — | — |
| Side trimmer | 1 | 1 | 1 | 1 |
| Oiling device | 1 | 1 | — | — |
| Cold rolling mill | 1 | 1 | 1 | 1 |
| Scale breaker | (1) | (1) | 1 | 1 |
| Mechanical descaling equipment | — | — | 1 | 1 |
| *Acid recovery system | 1 | 1 | — | — |
| *Water disposal system | 1 | 1 | — | — |
| *Coil storage | 1 | 1 | — | — |

TABLE III-continued

| Comparative Equipment | Prior Art | | The Invention | |
|---|---|---|---|---|
| Kind of equipment | FIG. 1 + FIG. 3 (set) | FIG. 1 + FIG. 4 (set) | FIG. 9 (set) | FIG. 10 (set) |
| *Coil transportation | 1 | 1 | — | — |

The equipment with * is not shown.

Since the scale breakers are very effective in descaling, they are in general incorporated in the high-speed pickling lines. For instance, they are skin pass mills.

It is to be understood that the present invention is not limited to the above described embodiments thereof and that various modifications may be effected within the true spirit thereof. For instance, the presnt invention has been described in detail in conjunction with the wet type blasting equipment which is used as the descaler, but any other suitable mechanical descalers may be equally employed.

The features and advantages of the present invention may be summarized as follows:

(1) Since the mechanical descaling equipment is employed, the energy required for descaling may be completely controlled. Furthermore the speed of the strip passing through the production line may be adjusted freely and completely depending upon a required velocity of the strip entering the continuous cold rolling mill. It is of course possible to pass the strip at a high speed. In addition, the pressure exerted to the strip may be optimumly varied depending upon its speed. As a result, no over-descaling results and the yield is improved.

(2) The operation cost may be considerably reduced. For instance, with the prior art pickling lines, the cost (that of acids) is 720 yen/ton, but with the mechanical descaling equipment in accord with the present invention, the cost (that of electricity) is 350 yen/ton.

(3) Since no acid is used, no acid vapor evolves and consequently no corrosion of the process and production equipment will occur.

(4) Depending upon required surface conditions, for instance, surface roughness, the angle of the abrasive and water nozzles and the distance between them and the surfaces of the strip to be treated may be easily and quickly changed.

(5) As compared with the prior art production line incorporating the pickling line, the over-all length of the production line may considerably reduced. For instance, the prior art production installation including the pickling line and the continuous cold rolling mill is approximately 350 meters in length, but the production installation in accordance with the present invention including the mechanical descaling line and the continuous cold rolling mill is only 165 meters in length.

(6) Because of the structual and functional features of the production line in accordance with the present invention, the provision of accumulaors is not needed so that the production line may be made very compact in size.

(7) Since no acid is used for descaling, the acid recovery system, the acid disposal system and so on are not required. As a consequence, the operation is safe and no environmental pollution problem will arise. In addition, the installation cost becomes very low.

(8) With the pickling equipment, the acids must be heated. However, no acid is used in the present invention so that considerable savings in energy may be attained.

(9) The side trimmer is disposed at the upstream of the mechanical descaling equipment or station so that the strip is cut to a predetermined width before entering the mechanical descaling equipment. As a result, as compared with the case wherein the side trimmer is disposed at the downstream of the mechanical descaling equipment, the consumption of abrasives and water may be considerably reduced and consequently savings in energy may be attained. Furthermore, any deformations left at the sides of the strip after the cutting by the side trimmer may be completely removed by the mechanical descaling equiment so that the surfaces of the work rolls in the continuous cold rolling mill may be prevented from being damaged. If the side trimmer is disposed at the downstream of the mechanical descaling equipment, the strip wetted with water and abrasives enters the side trimmer, causing rapid corrosion and wear of the cutting blades. However, according to the present invention, the side trimmer is disposed at the upstream of the mechanical descaling equipment so that such problems may be completely eliminated. Moreover, if the side trimmer is disposed at the downstream of the mechanical descaling equipment, the equipment for washing and cleaning the surfaces of the strip emerging from the mechanical descaling equipment and a dryer for drying the strip emerging out of the washing equipment must be installed between the mechanical descaling equipment and the side trimmer. As a consequence, the distance between the mechanical descaling equipment and the cold rolling mill becomes longer so that oxide films are formed on the surfaces of the strip before it enters the continuous cold rolling mill, whereby the quality of cold rolled products is degraded. However, the layout of the cold rolled metal sheet or strip production line in accord with the present invention may completely overcome the above problems. (10) In the scale breaker, the strip is subjected to the reduction at the reduction ratio of higher than 6% so that scales on the surfaces of the strip may be easily removed. As a result, as compared with the case wherein the strip is not subjected to reduction prior to entering the mechanical descaling equipment or station, the amount of abrasives impinged against the surfaces of the strip may be reduced to $\frac{1}{2}$–$\frac{1}{3}$. Thus, savings in energy can be attained. Furthermore, as a result of the reduction to which is subjected the strip, scales over the surfaces thereof are broken and at the same time the strip is increased in surface hardness so that the amount of materials removed from the strip itself during descaling may be minimized. Consequently, the yield may be increased. Moreover, since the strip is hardened, the tendency of the abrasives for adhering to the surfaces of the strip is decreased so that the oxidation and corrosion of the surfaces of the strip may be avoided. In addition, because of the reduction at a high reduction ratio in the scale breaker, the reduction ratio to be attained in the continuous cold rolling mill may be reduced so that the strip may be cold rolled to accurate shapes and dimensions.

(11) Because of the features and advantages described above, the mechanical descaling equipment or station may be connected to the continuous cold rolling mill in a simple manner. As a result, the production time (hour/ton) may be considerably reduced and the operation cost may be decreased to $\frac{1}{3}$. So far, it takes about a few days before the hot-rolled strip leaving from the continuous hot rolling mill enters the continuous cold rolling mill in the prior art cold-rolled sheet or strip production lines, but according to the present invention it takes only a few hours before the hot-rolled strip or sheet enters the continuous cold rolling mill after emerging from the continuous hot rolling mill.

We claim:

1. An installation for the production of continuously cold rolled sheet metal or strip comprising means for uncoiling a coil of hot-rolled sheet metal or strip, means for edging the leading and trailing ends of the preceding sheet metal or strip in such a way that the trailing end of the preceding sheet metal or strip may be correctly registered with the leading end of the succeeding sheet metal or strip, means for welding the uncoiled sheet metal or strip, means for trimming the side edges of the sheet metal or strip thus welded together so that the sheet metal or strip may have a predetermined width, means disposed at the downstream of said trimming means for mechanically descaling the surfaces of the sheet metal or strip, means for cleaning the surfaces of the sheet metal or strip emerging from said mechanical descaling means, means for shearing off the sheet metal or strip into a predetermined length, and means for recoiling the sheet metal or strip thus sheared off, all of said means being arranged in the order named.

2. An installation for the production of continuously cold rolled sheet metal or strip comprising means for uncoiling a coil of hot-rolled sheet metal or strip, means for edging the leading and trailing ends of the uncoiled sheet metal or strip in such a way that the trailing end of the preceding sheet metal or strip may be correctly registered with the leading end of the succeeding sheet metal or strip, means for welding the uncoiled sheet metal or strip, means for trimming the side edges of the sheet metal or strip thus welded together so that the sheet metal or strip may have a predetermined width, means disposed at the downstream of said side trimming means for rolling the sheet metal or strip under high pressure, thereby correcting the shape thereof and simultaneously breaking scales on the surfaces thereof, means disposed at the downstream of said scale breaking means for mechanically descaling the surfaces of the sheet metal or strip, means for cleaning the surfaces of the sheet metal or strip emerging from said mechanical descaling means, means for shearing off the sheet metal or strip into a predetermined length, and means for recoiling the sheet metal or strip thus sheared off, all of said means being arranged in the order named.

3. An installation for the production of continuously cold rolled sheet metal or strip comprising means for uncoiling a coil of hot-rolled sheet metal or strip, means for edging the leading and trailing ends of the uncoiled sheet metal or strip in such a way that the trailing end of the preceding sheet metal or strip may be correctly registered with the leading end of the succeeding sheet metal or strip, means for welding the uncoiled sheet metal or strip, means for trimming the side edges of the sheet metal or strip, thus welded together so that the sheet metal or strip may have a predetermined width, means disposed at the downstream of said side trimming means for rolling the sheet metal or strip under high pressure, thereby correcting the shape thereof and simultaneously breaking scales on the surfaces thereof, means disposed at the downstream of said scale breaking means for mechanically descaling the surfaces of the sheet metal or strip, means for cleaning the surfaces of the sheet metal or strip emerging from said mechanical descaling means, a continuous cold rolling mill, means for shearing off the cold rolled sheet metal or strip into a predetermined length, and means for recoiling the cold rolled sheet metal or strip, all of said means being arranged in the order named.

4. An installation for the production of continuously cold rolled sheet metal or strip comprising means for uncoiling a coil of hot-rolled sheet metal or strip, means for edging the leading and trailing ends of the uncoiled sheet metal or strip in such a way that the trailing end of the preceding sheet metal or strip may be correctly registered with the leading end of the succeeding sheet metal or strip, means for welding the uncoiled sheet metal or strip, means for feeding the sheet metal or strip thus welded together to accumulator means, means for trimming the side edges of the sheet metal or strip thus welded together so that the sheet metal or strip may have a predetermined width, means disposed at the downstream of said side trimming means for rolling the sheet metal or strip under high pressure, thereby correcting the shape thereof and simultaneously breaking scales on the surfaces thereof, means disposed at the downstream of said scale breaking means for mechanically descaling the surfaces of the sheet metal or strip, means for cleaning the surfaces of the sheet metal or strip emerging from said mechanical descaling means, a continuous cold rolling mill, means for shearing off the cold rolled sheet metal or strip into a predetermined length, and means for recoiling the cold rolled sheet metal or strip, all of said means being arranged in the order named.

* * * * *